United States Patent [19]

Ichikawa et al.

[11] Patent Number: 4,635,594

[45] Date of Patent: Jan. 13, 1987

[54] METHOD OF APPLYING ELECTRIC CURRENT TO GLOW PLUGS AND DEVICE THEREFOR

[75] Inventors: Sadao Ichikawa; Shinichi Yokoi, both of Nagoya; Seishi Yasuhara; Hiroshi Kondo, both of Yokohama, all of Japan

[73] Assignees: NGK Spark Plug Co., Ltd., Nagoya; Nissan Motor Co., Ltd., Yokohama, both of Japan

[21] Appl. No.: 699,851

[22] Filed: Feb. 8, 1985

[30] Foreign Application Priority Data

Feb. 10, 1984 [JP] Japan ..... 59-21587

[51] Int. Cl.[4] ..... F02P 19/02

[52] U.S. Cl. ..... 123/179 BG; 123/179 H

[58] Field of Search ... 123/179 BG, 179 B, 179 H:145 A

[56] References Cited

U.S. PATENT DOCUMENTS

| | | | |
|---|---|---|---|
| 4,350,876 | 9/1982 | Kubota et al. | 123/179 H |
| 4,375,205 | 3/1983 | Green | 123/179 H |
| 4,391,237 | 7/1983 | Abe et al. | 123/179 H |
| 4,458,639 | 7/1984 | Abe et al. | 123/145 A |
| 4,512,297 | 4/1985 | Ichikawa et al. | 123/179 BG |

*Primary Examiner*—Andrew M. Dolinar

*Attorney, Agent, or Firm*—Fleit, Jacobson, Cohn & Price

[57] ABSTRACT

Electric currents are applied to parallel-connected glow plugs for preheating, to serial-connected glow plugs for running, and to intermittently reconnected parallel/-serial glow plugs for cranking.

10 Claims, 13 Drawing Figures

ON
D21
D209
ZD22
T1
P1
R204
R206
ZD21
IC1
R202
D22
Vc1
V11
OR1
R203
C21
R208
R207
P2
OSC1
R219
R210
D24
R213
R214
D23
Vc2
IC22
V21
V22
AND21
R220
D26
C22
R211
R215
R216
R212
R217
INV21
Q21
R218
AND22
R221
INV24
Q22
R222
D24
D25
INV22
INV23

METHOD OF APPLYING ELECTRIC CURRENT TO GLOW PLUGS AND DEVICE THEREFOR

BACKGROUND OF THE INVENTION

1. Field of the Invention

This invention relates to a method and device for applying electric currents to glow plugs of diesel engine cylinders, so as to ensure smooth start of such engines especially automobile engines. More particularly, the invention relates to regulation of the power consumption in the glow plugs by switching the connection of the glow plugs from parallel to serial and vice versa so as to couple either the parallel-connected or serial-connected glow plugs to a power source such as a car battery.

2. Description of the Prior Art

It has been practiced to regulate the power consumption in glow plugs of engine cylinders, for instance by using a high power consumption in the glow plugs during the preheat period and reducing the power consumption in them during the after-glow or keep-warm period following the preheat. In fact, the inventors disclosed a method for regulating the glow plug power consumption in their Japanese Patent Laying-open Publication No. 192,972/1983, in which the connection of the glow plugs to a power source is changed between parallel and serial. As compared with a conventional method of inserting a current-limiting resistor means in series to the glow plugs after finishing the preheating thereof, the above method of the inventors has a merit of reducing the waste in the power consumption.

However, the method of the prior art has a shortcoming in that satisfactory engine starting characteristics and the engine warming up characteristics cannot be achieved, because the glow plug temperature control of the prior art does not provide optimal glow plug temperature separately for different operating periods such as the preheating period, the cranking period or the starter motor running period, and the after-glow period following the engine start.

SUMMARY OF THE INVENTION

Accordingly, an object of the present invention is to obviate the above-mentioned shortcoming of the prior art by providing an improved method and device for applying electric currents to glow plugs.

More specifically, an object of the invention is to eliminate the power loss caused by serial insertion of the current-limiting resistor means to the glow plug circuit in the conventional method. The elimination of such loss will result in an increased reserve capacity of the car battery.

Another object of the invention is to provide a method for separately regulating the power consumption of the glow plugs in three different periods; namely, a preheating period, a cranking period or a starter motor running period, and an after-glow period. With the three-stage power regulation, the temperature of the glow plugs after the preheating can be controlled in an excellent manner, and needless loading of the car batteries can be eliminated. Whereby, considerable improvement is achieved in the engine starting characteristics and engine warming up characteristics.

A further object of the invention is to provide a device which includes a means for applying electric currents to the glow plugs in a chopped manner during the cranking period. In the stage of applying currents in a chopped manner, the glow plugs are normally connected in parallel to each other so as to couple the parallel-connected glow plugs to a power source, while the glow plugs are intermittently reconnected in a serial fashion and the serial-connected glow plugs are intermittently coupled to the power source in lieu of the parallel-connected glow plugs. In general, such reconnection of the glow plugs from parallel to serial and vice versa tends to cause unpleasant pulsation in the brightness of automobile lighting system or other unpleasant effects. The inventors have succeeded in minimizing such unpleasant effects by limiting the chopped application of currents only to the cranking period.

To fulfill the above objects, in a method for applying electric currents to glow plugs of engine cylinders according to the present invention, the glow plugs are connected in parallel to each other for preheating, and the parallel-connected glow plugs are coupled to the power source. During the cranking period after the preheating, the connection of the glow plugs are repeatedly switched between parallel and serial by a switching relay means, so that the parallel-connected glow plugs and serial-connected glow plugs are alternately coupled to the power source in a cyclic manner. After the cranking, the serial-connected glow plugs are coupled to the power source.

In the cranking period, one or both of the duration of the parallel-connection and the duration of the serial-connection can be determined depending on the voltage of the glow plug.

A suitable delay time may be provided at the time of each reconnection of the glow plugs from serial to parallel and vice versa.

An embodiment of the device for applying electric currents to glow plugs of engine cylinders according to the invention is applicable to an engine having an engine key switch with an ON position for making circuit of a power source and an ST position for cranking the engine by running a starter motor. A first switch means is provided so as to connect the glow plugs in parallel to each other and to couple the parallel-connected glow plugs to the power source, and a second switch means is provided so as to connect the glow plugs in a serial manner and to couple the serial-connected glow plugs to the power source. To actuate only one of said first switch means and said second switch means at a time, a selective means is operatively connected to both said first and second switch means.

A preheat timer is connected to the ON position of the engine key switch, which preheat timer is adapted to produce a high-level signal for a certain preheat time after the engine key switch is turned to the ON position. To effect the alternate reconnection of the glow plugs, an oscillator circuit is connected at least to said ST position of the engine key switch, which oscillator circuit is adapted to intermittently produce high-level signals when the engine key switch is at the ST position. Both the output from the preheat timer and the output from the oscillator circuit are connected to a logical sum (OR) circuit, and the output from the OR circuit is connected to said first switch means through the selective means.

The above-mentioned oscillator circuit may include a voltage comparator with feedback resistors, which voltage comparator has a first input terminal coupled to said ON position of the engine key switch and a second input terminal coupled to a capacitor. The voltage comparator produces a high-level output signal when voltage at its first input terminal is higher than voltage at its second input terminal. The capacitor is connected to a charging circuit which is adapted to be triggered by a start signal from the ST position so as to couple the voltage of the glow plug to the capacitor. The capacitor is also connected to a discharge circuit which is adapted to be triggered by an inverse of low-level output from the voltage comparator under the presence of the start signal from the ST position so as to discharge the capacitor.

To ensure proper charging of the capacitor of the oscillator circuit during the cranking period, another charging circuit may be connected to the capacitor, which other charging circuit is adapted to be triggered by an inverse of the signal for triggering the above-mentioned discharge circuit so as to couple the voltage of serial-connected glow plugs to the capacitor through a diode.

In another embodiment of the device for applying electric currents to glow plugs of engine cylinders according to the invention, a preheat timer also fulfils the function of the oscillator circuit for the reconnection of the glow plugs. The preheat timer of such embodiment is connected to both the ON position and the ST position of the engine key switch KS and includes a voltage comparator with feedback resistors, which voltage comparator has a first input terminal coupled to the ON positon of the engine key switch and a second input terminal coupled to a capacitor. The voltage comparator is adapted to produce a high-level output signal when the voltage at its first input terminal is higher than the voltage at its second input terminal.

To facilitate the charging, the capacitor of the voltage comparator of this embodiment is connected to a charging circuit coupled to the ON position of the key switch KS through a voltage divider and another charging circuit coupled to the voltage of the glow plugs through another voltage divider. To discharge the capacitor after connected to a charging circuit adapted to be triggered by a start signal from the ST position so as to couple the voltage of the glow plug to the capacitor through a voltage divider.

To facilitate the discharging of the capacitor after the cranking period is started by turning the key switch KS to the ST position, the capacitor is connected to a discharge circuit adapted to be triggered by an inverse signal of the low-level output from the voltage comparator under the presence of the start signal from the ST position of the engine key switch KS so as to discharge the capacitor. The output of the preheat timer of such embodiment is directly connected to a selective means, which is adapted to actuate only one of the above-mentioned first switch means and the above-mentioned second switch means at a time while actuating the first switch means only when the high-level output signal is received from the preheat timer.

A memory circuit may be connected to the output of the voltage comparator, which memory circuit is adapted to memorize that a preheat time immediately after the turning of the key switch KS to its ON position is over, so as to actuate an additional charging circuit to be described hereinafter.

To ensure proper charging of the capacitor of the voltage comparator during the cranking period, an additional charging circuit may be connected to the capacitor, which additional charging circuit is adapted to be triggered by said memory circuit, so as to couple the voltage of the glow plugs to the capacitor through another voltage divider. This additional charging circuit may couple the voltage of the serial-connected glow plugs to the capacitor through another voltage divider.

BRIEF DESCRIPTION OF THE DRAWING

For a better understanding of the invention, reference is made to the accompanying drawing, in which.

Throughout different views of the drawings, A is a burn-out alarm circuit, AL is an alarm lamp, AND collectively shows logical product (AND) circuits, B is an after-glow timer, C collectivly shows capacitors, D collectively shows diodes, DI is a discharge circuit, E is a power source, G is a feedback circuit for capacitor discharge, I is a parallel-connection relay and contact points of the relay, II is a serial-connection relay and contact points of the relay, IC collectively shows voltage comparators, INV collectively shows inverters, KS is an engine key switch, L is a preheat pilot lamp, M is a memory circuit, l is a regulator terminal, ON is a turn-on position, OR collectively shows logical sum (OR) circuits, OSC collectively shows oscillator circuits, P collectively shows glow plugs, p1 and p2 are terminals, Q collectively shows transistors, R collectively shows resistors, S is a vehicular speed switch, ST is a start position, StM is a start memory circuit, T collectively shows timers, TL is a pilot lamp timer of water temperature depending type, and W is a water temperature sensor.

DESCRIPTION OF THE PREFERRED EMBODIMENT

Figure 1:
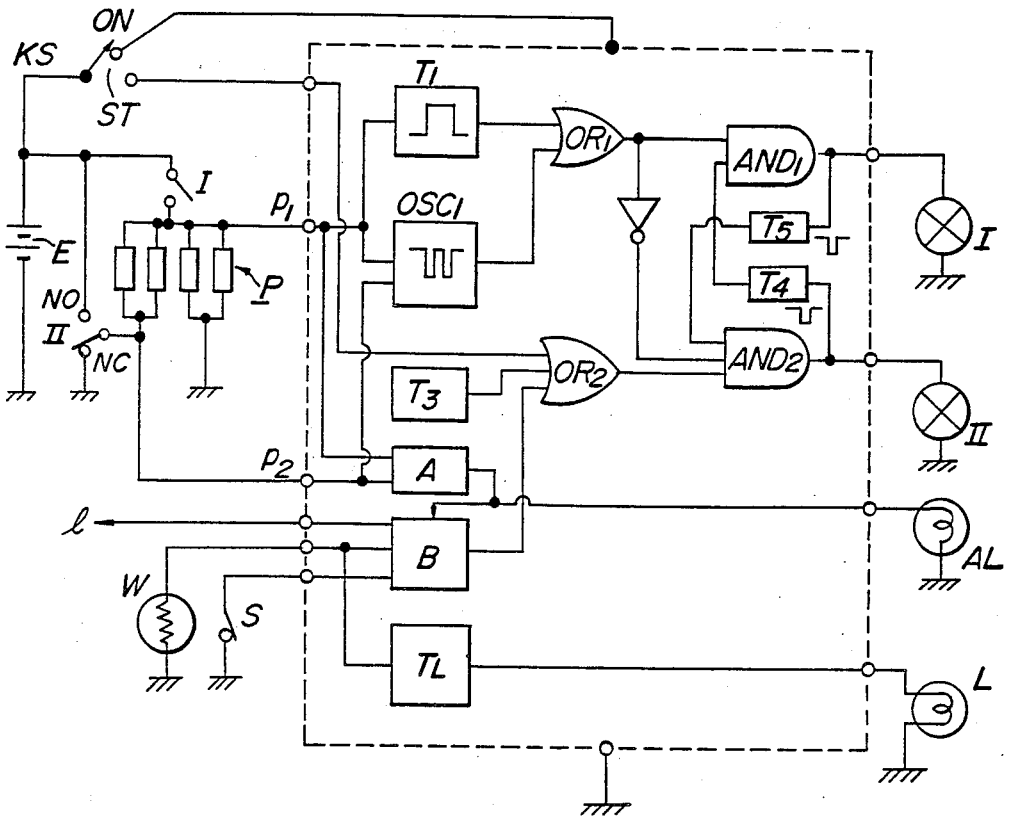
FIG. 1 is a schematic block diagram of a device for applying electric currents to glow plugs of engine cylinders according to the invention.
Figure 2:
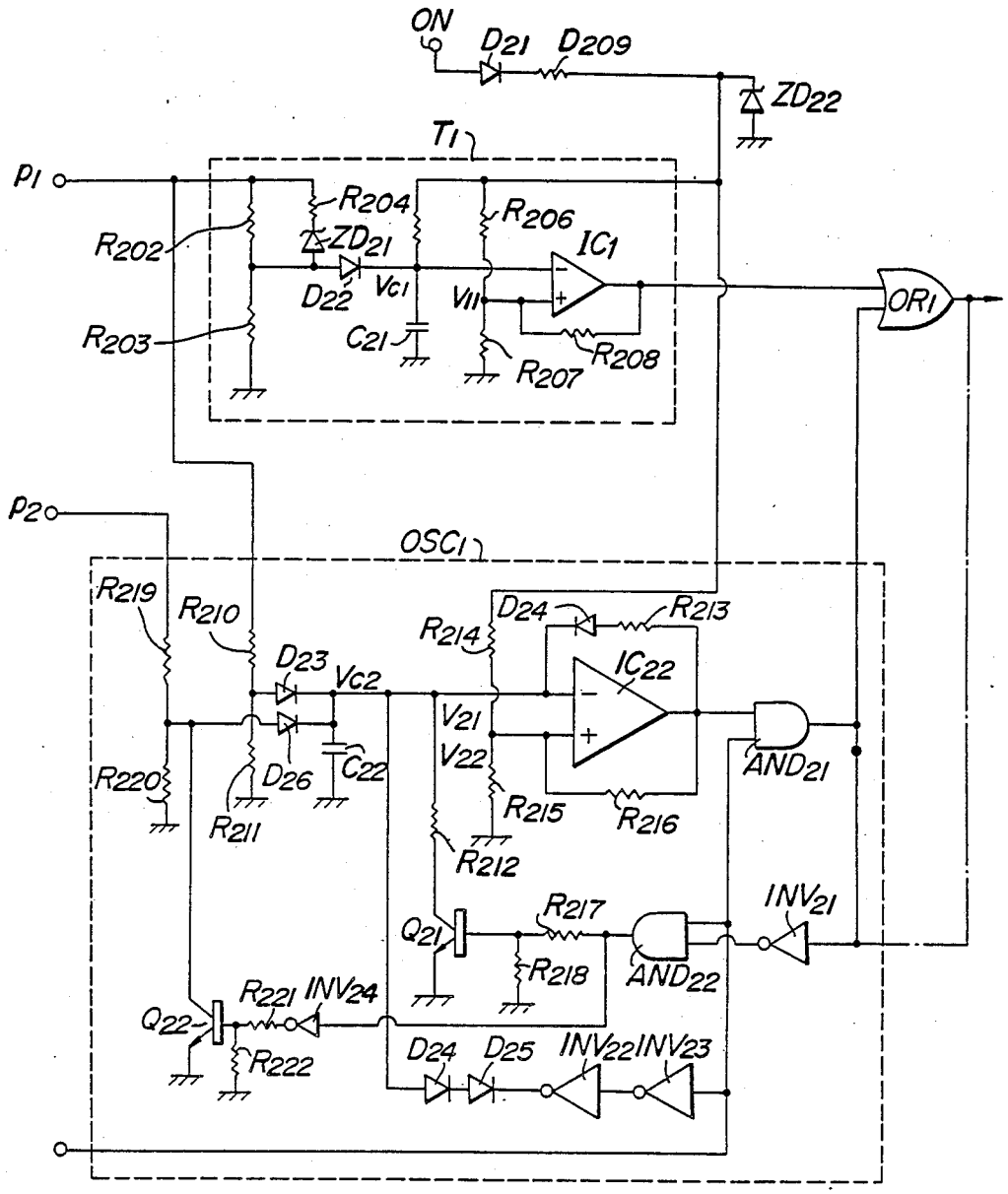
FIG. 2 is an electric circuit diagram of essential portions of the device of FIG. 1.
Figure 3:
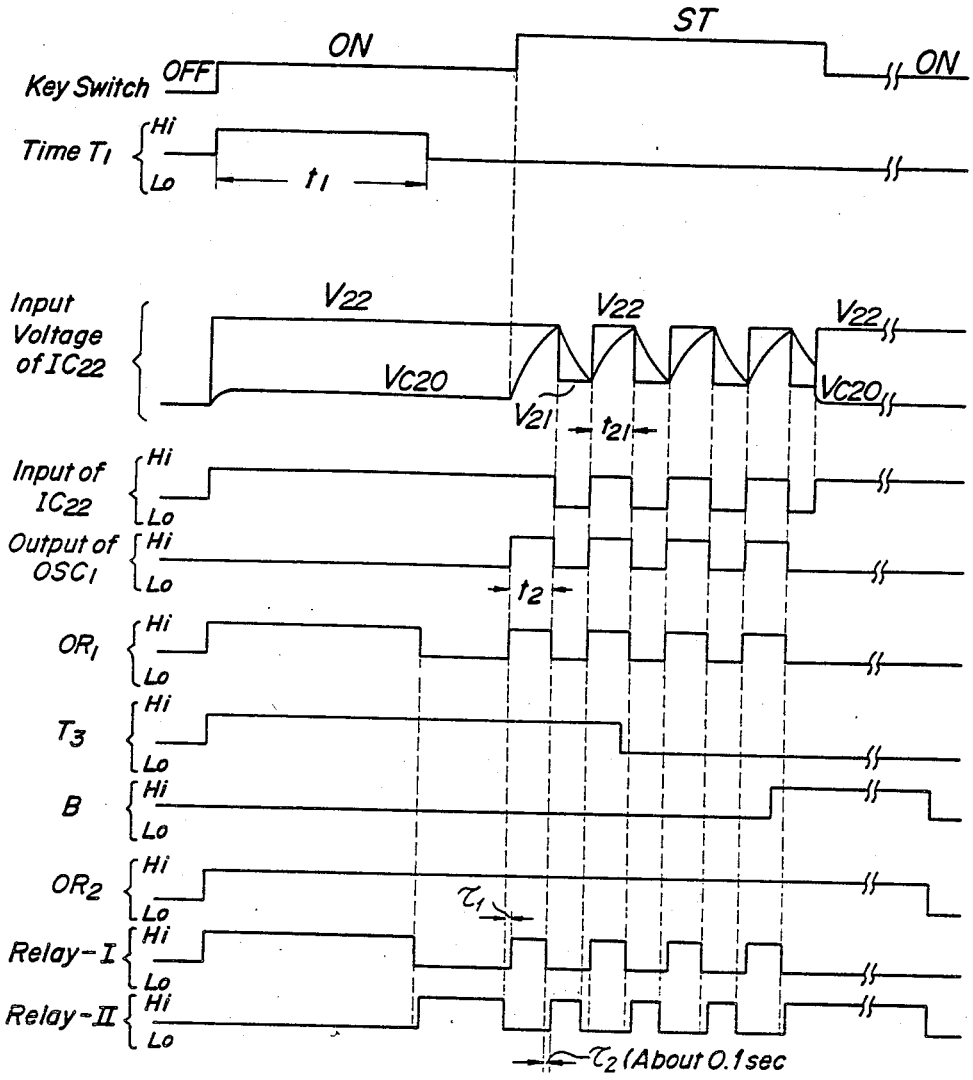
FIG. 3 is a time chart of the operation of the device of FIG. 1.

The invention will be described in detail now by referring to a preferred embodiment illustrated in the drawing. FIG. 1 shows the overall configuration of a first embodiment of the device according to the invention, and FIG. 2 shows circuit diagrams of essential portions of the device. FIG. 3 shows time charts of the operation of the device of FIG. 1.

A power source E, such as a car battery, is connected to glow plugs P through relay contact points I and II, so that the glow plugs P are connected in parallel to each other as shown in FIG. 8(*b*) or in a serial fashion as shown in FIG. 8(*d*) depending on the operation of a parallel-connection relay I and a serial-connection relay II. The serial-connection relay II is of transfer type, and its normally closed contact point NC is for parallel connection of the glow plugs P while its normally open contact point NO is for their serial connection. The power source E is also connected to an engine key switch KS having a turn-on position ON and a start position ST.

For preheating prior to the cranking or before the running of a starter motor, the parallel-connected glow plugs P are connected to the power source E. During the after-glow period following the start of the engine, the serial-connected glow plugs P are connected to the power source E. When the cranking of the engine is started after the preheating, or when the starter motor (not shown) is running, the serial-connected glow plugs P are at first connected to the power source E and then the connection of the glow plugs P is switched to parallel to each other so as to couple the parallel-connected glow plugs P to the power source E. Thereafter, the connection of the glow plugs P is cyclically switched between parallel and serial during the engine cranking.

A preheat timer $T_1$ is connected to the power source E when the engine key switch KS is turned to its circuit-making or turn-on position ON (FIG. 2). The output of the preheat timer $T_1$ and the output from an oscillator circuit $OSC_1$ are connected to an OR circuit $OR_1$, and the output form the OR circuit $OR_1$ is applied to the parallel-connection relay I through an AND circuit $AND_1$. The output of the OR circuit $OR_1$ is also connected to an inverter $INV_1$, which is coupled to the serial-connection relay II through another AND circuit $AND_2$, so that priority is given to the parallel connection of the glow plugs P rather than to the serial connection thereof.

The start position ST of the engine key switch KS, a temperature-holding timer $T_3$, and an after-glow timer B are connected to the-serial connection relay II through an OR circuit $OR_2$ and an AND circuit $AND_2$. A burn-out or line-breakage alarm circuit A, which is coupled with the glow plugs P in a manner to be described in detail later, is connected to an alarm lamp AL. The input side of the after-glow timer B is connected to a regulator terminal l coupled with an engine dynamo, a water temperature sensor W, and a vehicular speed switch S. A preheat pilot lamp L is connected to the water temperature sensor W through a pilot lamp timer TL of water temperature depending type.

The output from the AND circuit $AND_1$ is connected to the input of the other AND circuit $AND_2$ through a delay timer $T_5$, while the output from the AND circuit $AND_2$ is connected to the input of the AND circuit $AND_1$ through another delay timer $T_4$. The delay timer $T_4$ produces a low-level (Lo) pulse for a period of $\tau_1$, preferably about 0.16 sec, immediately after the turning off of the actuating current through the serial-connection relay II. The other delay timer $T_5$ produces a low-level pulse for a period of $\tau_2$, preferably about 0.1 sec, immediately after the turning off of the actuating current through the parallel-connection relay I. The latter delay timer $T_5$ is particularly useful in protecting the normally closed contact point NC of the serial-connection relay II of the transfer type.

Referring to FIG. 2, the preheat timer $T_1$ and the oscillator $OSC_1$, which form the essential portions of the current control device of the invention, are connected to the glow plugs P at terminals p1 and p2 of FIG. 1. The preheat timer $T_1$, which is of voltage control type in this embodiment, is actuated at the moment when the engine key switch KS is turned to the ON position, while the oscillator circuit $OSC_1$, which is a kind of chopping circuit, is switched on and off depending on the voltage of the glow plug P during the engine cranking with the key switch KS at the position ST.

As the key switch KS is turned to the ON position, a voltage $V_{11}$ is applied to the plus (+) terminal of the voltage comparator circuit $IC_1$, which voltage $V_{11}$ is the output from the voltage divider connected to the ON position of the key switch KS through resistors $R_{206}$, $R_{207}$ and $R_{208}$. A capacitor $C_{21}$, which is not charged and at zero volt at this moment, is connected to the minus (−) terminal of the voltage comparator $IC_1$. In response to the voltage $V_{11}$ at the plus (+) terminal and zero volt at the minus (−) terminal, the voltage comparator $IC_1$ produces a high level Hi output signal. This Hi output signal is applied to the parallel-connection relay I through the OR circuit $OR_1$ and the AND circuit $AND_1$. The Hi output signal from the AND circuit $AND_1$ triggers the timer $T_5$ so as to disable the output from the other AND circuit $AND_2$ and the serial-connection relay II. Accordingly, the parallel-connection relay I is energized so as to close its relay contact I while keeping the operation of the serial-connection relay II at its normally closed contact point NC, and the glow plugs P are connected in parallel to each other, as shown in FIG. 8(*b*).

The capacitor $C_{21}$ is charged through two circuits; namely, from the voltage terminal p1 of the glow plugs P through a voltage divider made of resistors $R_{202}$ and $R_{203}$, and from the voltage at the ON position of the key switch KS through a resistor $R_{205}$. With such charging of the capacitor $C_{21}$ through the two circuits, it takes a time period $t_1$ for the voltage $V_{C1}$ (FIG. 2) of the capacitor $C_{21}$ to increase up to the level of the voltage $V_{11}$ at the plus (+) terminal of the voltage comparator $IC_1$. Thus, the voltage comparator $IC_1$ produces the Hi output signal for the time period $t_1$ (FIG. 3).

It is noted that this time period $t_1$ depends on the voltage of the glow plugs P, because a part of the charging current to the capacitor $C_{21}$ comes from the voltage at the terminal p1 of the glow plugs P through the voltage divider made of the resistors $R_{202}$ and $R_{203}$.

At the end of the preheat time period $t_1$, the output signals of the circuits $OR_1$ and $AND_1$ become low Lo levels, and the keep-warm timer $T_3$ is actuated so as to deliver a high Hi output signal to the AND circuit $AND_2$ through the OR circuit $OR_2$. The delay timer $T_5$ responds to the Lo output signal from the $AND_1$ circuit, and produces a low Lo level signal for a time period $\tau_2$, e.g., for 0.1 sec, and then a high Hi level signal. The inverter circuit $INV_1$ applies a high Hi level signal to the $AND_2$ circuit in response to the Lo level signal from the $OR_1$ circuit. Accordingly, at 0.1 second after the deenergization of the parallel connection relay I, the $AND_2$ circuit produces a high Hi level signal and the serial-connection relay II is energized, as shown in FIG. 3. Thus, the keep-warm operation takes place with the glow plugs P connected in a serial fashion, as shown in FIG. 8(*d*).

On the other hand, in the oscillator circuit $OSC_1$, as the key switch KS is turned to the ON position, a voltage $V_{22}$ is applied to the plus (+) terminal of the voltage comparator circuit $IC_{22}$, which voltage $V_{22}$ is the output from a voltage divider connected to the ON position of the key switch KS through resistors $R_{214}$, $R_{215}$ and $R_{216}$. A capacitor $C_{22}$, whose voltage $V_{C2}$ is at a low level $V_{C20}$ at this moment (FIG. 3), is connected to the minus (−) terminal of the voltage comparator $IC_{22}$. In response to the voltage $V_{22}$ at the plus (+) terminal and the Lo level signal at the minus (−) terminal, the voltage comparator $IC_{22}$ produces a high level Hi output signal.

Although a charging circuit for the capacitor $C_{22}$ is formed at least from the voltage at the terminal p1 of the glow plugs P through a voltage divider made of resistors $R_{210}$ and $R_{211}$, the electric charge of the capacitor $C_{22}$ is drained to the position ST of the key switch KS through diodes $D_{24}$ and $D_{25}$, because the lack of active voltage at the position ST enables the two diodes through inverters $INV_{22}$ and $INV_{23}$. Thus, the voltage $V_{C2}$ of the capacitor $C_{22}$ is kept at the low level $V_{C20}$ until the key switch KS is turned to the start position ST so as to apply a high Hi level signal thereto, so that the output from the voltage comparator $IC_{22}$ remains at the high Hi level until Hi level signal appears at the position ST. However, such Hi level output signal from the voltage comparator $IC_{22}$ is not applied to the $OR_1$ circuit, because an $AND_{21}$ therebetween is unabled by the Lo level signal from the ST position.

Accordingly, during the keep-warm period in which no Hi level signal is available at the ST position of the key switch KS, the oscillator circuit $OSC_1$ cannot energize the parallel-connection relay I.

If the key switch KS is turned to the ST position under such conditions, a Hi level signal is applied to the ST position from the power source E, and the $AND_{21}$ circuit is enabled, so as to pass the Hi level output signal from the voltage comparator $IC_{22}$ toward the $OR_1$ circuit. When the key switch KS is turned to the ST position, the capacitor $C_{22}$ is not charged yet, and the voltage comparator $IC_{22}$ produces the Hi level output signal. As the output from the $OR_1$ circuit is turned to the Hi level, the serial-connection relay II is deenergized through the inverter $INV_1$ and the $AND_2$ circuit and the circuit of its normally closed contact point NC is completed. In response to the Lo level signal from the $AND_2$ circuit, the timer $T_4$ produces an Lo level signal for a time period $\tau_1$, for instance for 0.1 second, and thereafter resumes Hi level. Thus, at 0.1 second after the key switch KS is turned to the ST position, the parallel-connection relay I is energized, and the connection of the glow plugs P is switched from serial to parallel.

When the glow plugs P are connected in parallel to each other after the start signal ST is given, the capacitor $C_{22}$ is charged from two sources; namely, from the terminal p1 of the glow plugs P through a voltage divider made of resistors $R_{210}$ and $R_{211}$ and from the output of the voltage comparator $IC_{22}$ through a feedback resistor $R_{213}$. In a time period $t_2$ (FIG. 3) from the beginning of the start signal ST, the voltage $V_{C2}$ of the capacitor $C_{22}$ increases to the level of the voltage $V_{22}$ at the plus (+) terminal of the voltage comparator $IC_{22}$, and until the end of such time period $t_2$, the output from the voltage comparator $IC_{22}$ produces a high Hi level signal. Since the capacitor $C_2$ is charged at least partly from the output of the voltage divider made of resistors $R_{210}$ and $R_{211}$ driven by the voltage at the terminal p1 of the glow plugs P, the time period $t_2$ depends on the voltage of the glow plugs P.

When the voltage of the capacitor $C_{22}$ reaches the voltage $V_{22}$ at the plus (+) terminal of the voltage comparator $IC_{22}$, the output from the voltage comparator $IC_{22}$ becomes low Lo level, and the parallel-connection relay I is deenergized while a serial-connection relay II is energized with a time delay of $\tau_2$ of about 0.1 second of the delay timer $T_5$. Accordingly, the glow plugs P are connected in a serial fashion. Upon deenergization of the parallel-connection relay I during the cranking operation, a transistor $Q_{21}$ is made conductive by a circuit through an inverter $INV_{21}$ and an AND circuit $AND_{22}$, so that the capacitor $C_{22}$ starts to discharge. Thereby, one cycle of the switching of the connection of the glow plugs P between serial and parallel is completed.

Thereafter, as the capacitor $C_{22}$ is discharged to a certain voltage $V_{21}$ (FIG. 3), the output from the voltage comparator $IC_{22}$ becomes high Hi level again to switch the connection of the glow plugs P from serial to parallel in the above-mentioned manner. At the same time, the charging of the capacitor $C_{22}$ is resumed. In a time period $t_{21}$ (FIG. 3), the voltage $V_{C2}$ of the capacitor $C_{22}$ reaches the level of the voltage $V_{22}$ at the plus (+) terminal of the voltage comparator $IC_{22}$, and the connection of the glow plugs P is again switched from parallel to serial. This time period $t_{21}$ also depends on the voltage of the glow plugs P.

As long as the start signal ST is present, the output from the voltage comparator $IC_{22}$ and accordingly that from the oscillator $OSC_1$ oscillates with the ON time $t_{21}$ depending on the voltage of the glow plugs P.

Referring to FIG. 3, the first ON time $t_2$ of the oscillator $OSC_1$ immediately after the rise of the start signal ST is longer than the ON time $t_{21}$ during the oscillation. The reason for it is in that the voltage $V_{C20}$ of the capacitor $C_{22}$ before the ST signal, depending on the discharge circuit through the diodes $D_{24}$, $D_{25}$ and inverters $INV_{22}$, $INV_{23}$, is lower than the above-mentioned certain voltage $V_{21}$ for triggering the voltage comparator $IC_{22}$.

However, the above-mentioned certain voltage $V_{21}$ can be selected to be closed to the discharged voltage $V_{C20}$ of the capacitor $C_{22}$, because the voltage $V_{C20}$ depends on the forward voltage drops of the diodes $D_{24}$ and $D_{25}$ while the voltage $V_{21}$ can be determined by selecting suitable resistance values for the resistors $R_{214}$, $R_{215}$, and $R_{216}$. Thereby, the first ON time $t_2$ of the oscillator $OSC_1$ can be made substantially the same as the succeeding ON time $t_{21}$ so as to eliminate any difficulty in practice.

Figure 4A:
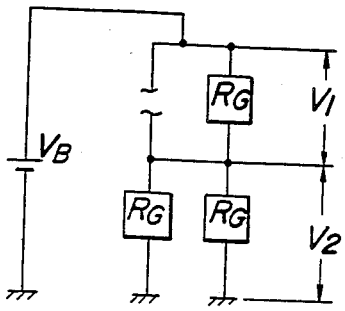
FIG. 4A is an explanatory diagram illustrating the circuit conditions of the glow plugs when one of them is burnt out.

An embodiment of the burn-out alarm circuit A will be described now. For simplicity, four glow plugs P are assumed to be grouped into two groups, each group having two glow plugs P connected in parallel, and the two groups are connected in series and the serial groups are connected across a power source with a voltage of $V_B$. When one of the glow plugs P is burned out and becomes non-conductive as shown in FIG. 4A, the voltage $V_1$ of the group with the burn-out glow plug and the voltage $V_2$ of the sound glow plug group are given by the following equations.

$$V_1 = \frac{R_G}{(1/2)R_G + R_G} V_B = \frac{1}{3/2} V_B = \frac{2}{3} V_B$$

$$V_2 = \frac{(1/2)R_G}{(1/2)R_G + R_G} V_B = \frac{1/2}{3/2} V_B = \frac{1}{3} V_B$$

As can be seen from the above equations, two-thirds ($\frac{2}{3}$) of the power source voltage $V_B$ is applied across the glow plug P is parallel to the burn-out glow plug P. Thus, the sound glow plug with the two-thirds power source voltage is exposed to a risk of burning out due to overvoltage.

To protect the glow plugs P against such overvoltage, a burn-out detection circuit is necessary.

Figure 4B:
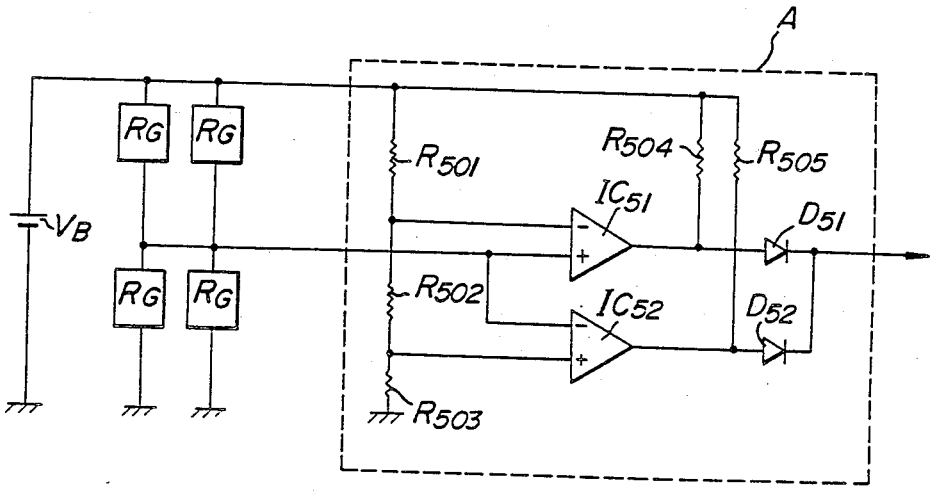
FIG. 4B is a circuit diagram of a detector of the burning out of the glow plug.

Referring to FIG. 4B, the following relationship between the voltage $V_{G1}$ across the two serial groups of the glow plugs and the voltage $V_{G2}$ across the group on the ground side can be determined from the above-mentioned equations.

(i) When a glow plug P on the non-grounded side group is burnt out.

$$V_{G2}=(\tfrac{7}{8})V_{G1} \quad (1)$$

(ii) When a glow plug P on the grounded side group is burnt out.

$$V_{G2}=(\tfrac{1}{8})V_{G1} \quad (2)$$

(iii) Under sound conditions.

$$V_{G2}=(\tfrac{1}{2})V_{G1} \quad (3)$$

Due to the dispersion of the voltage $V_{G2}$ relative to the voltage $V_{G1}$, the actual relationship therebetween is in the neighborhood of the above equations. Practical criteria for detecting the burn-out can be selected in the following manner by considering intermediate values among the above equations.

| | |
|---|---|
| $V_{G2} > (7/12)V_{G1}$ | for burn-out on non-grounded side |
| $(7/12)V_{G1} > V_{G2} > (5/12)V_{G1}$ | for sound conditions |
| $V_{G2} < (5/12)V_{G1}$ | for burn-out on grounded side |

In a detector circuit of FIG. 4B, the ratio among the resistance values of the resistors $R_{501}$, $R_{502}$, and $R_{503}$ is selected to be 5:2:5, a voltage comparator $IC_{51}$ generates a Hi signal for $V_{G2}>(7/12)V_{G1}$, and a voltage comparator $IC_{52}$ generates a Hi signal for $V_{G2}<(7/12)V_{G1}$.

The output Hi signals from the voltage comparators $IC_{51}$ and $IC_{52}$ are applied to the after-glow timer B, so as to cease the operation of the timer B. At the same time, such Hi signals are applied to the burn-out alarm AL, so as to actuate a suitable lamp or buzzer for informing the car driver of the burn-out of the glow plug.

Figure 5:
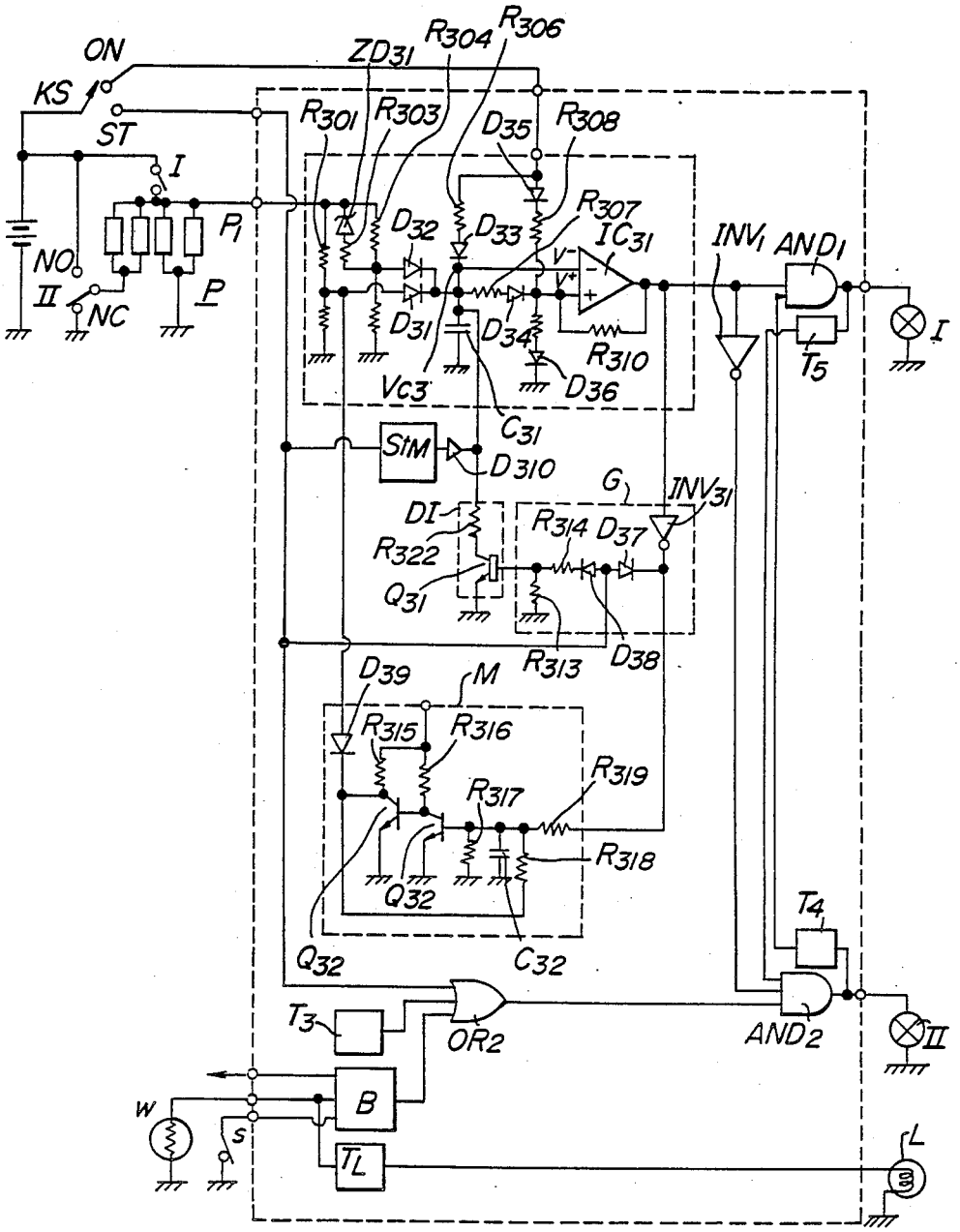
FIG. 5 is a schematic block diagram of another embodiment of the device for applying electric currents to glow plugs of engine cylinders according to the invention.

FIG. 5 shows another embodiment of the device for applying electric currents to glow plugs according to the invention. A preheat timer $T_{31}$ is actuated when the key switch KS is turned to its ON position, so as to act as a voltage-controlled timer with a preheat time $t_1$ depending on the voltage of the glow plug P. When a starter signal ST is generated after the preheat time $t_1$ is over, this preheat timer $T_{31}$ starts to act as an oscillator circuit having an ON time length, or the duration of the ON signal, depending on the voltage of the glow plugs P. The OFF time length of this oscillator circuit is constant.

The control device of FIG. 5 has a discharge circuit DI for a capacitor in the preheat timer $T_{31}$, which discharge circuit DI is connected to a discharge feedback circuit G coupled to the output of the preheat timer $T_{31}$. A memory circuit M connected to the discharge feedback circuit G is also coupled to the capacitor in the preheat timer $T_{31}$. A start memory circuit StM is connected to the start position ST of the key switch KS, so as to store that the key switch KS is turned from its position ON to its position ST. The start memory circuit StM generates a signal acting as a substitute of a full-ignition detecting signal. The embodiment of FIG. 5 is similar to that of FIG. 1 except the points explained above.

To preheat the glow plugs P, the key switch KS is turned to its ON position, and a voltage V+ is applied to the plus (+) terminal of the voltage comparator $IC_{31}$ from the ON position of the key switch KS through a diode $D_{35}$ and a voltage divider made of resistors $R_{308}$ and $R_{309}$. A capacitor $C_{31}$ connected to the minus (−) terminal of the voltage comparator $IC_{31}$ is not charged at this moment, so that the voltage comparator circuit $IC_{31}$ generates a high Hi level signal. Since the output from a timer $T_4$ at this moment is at Hi level, the Hi level output signal from the voltage comparator $IC_{31}$ is delivered to the parallel-connection relay I through the AND circuit $AND_1$ so as to energize it. Thereby, the contact I of the parallel-connection relay I is closed, and the glow plugs P are connected in parallel for preheating, as shown in FIG. 8(*b*).

At this moment, a low Lo level signal from the inverter $INV_{31}$ is applied to the memory circuit M, so that the collector of a transistor $Q_{32}$ in the memory circuit M is kept at a low potential. Thereby, the transistor $Q_{32}$ and a diode $D_{29}$ become conductive, and the output from a voltage divider, which is actuated from the terminal p1 of the glow plugs P and made of resistros $R_{301}$ and $R_{302}$, is drained to the earth through the transistor $Q_{32}$. Accordingly, the capacitor $C_{31}$ connected to the voltage comparator $IC_{31}$ is charged from two sources; namely, from the terminal p1 of the glow plugs P through another voltage divider made of resistors $R_{304}$ and $R_{305}$, and from the voltage at the position ON of the key switch KS through a resistor $R_{306}$. When the voltage of the glow plugs P is too high, the charging is effected through a circuit made of a Zener diode $ZD_{31}$ and a resistor $R_{303}$, so as to protect the glow plugs P against burning out or melting.

Thus, the voltage comparator $IC_{31}$ acts to cause the preheat timer $T_{31}$ to produce the Hi level signal for a time period $t_1$ during which the capacitor $C_{31}$ is charged. More specifically, the voltage $V_{C3}$ of the capacitor $C_{31}$ increases from the fully discharged level to the voltage V+at the plus (+) terminal of the voltage comparator circuit $IC_{31}$ in the above time period $t_1$.

Figure 6:
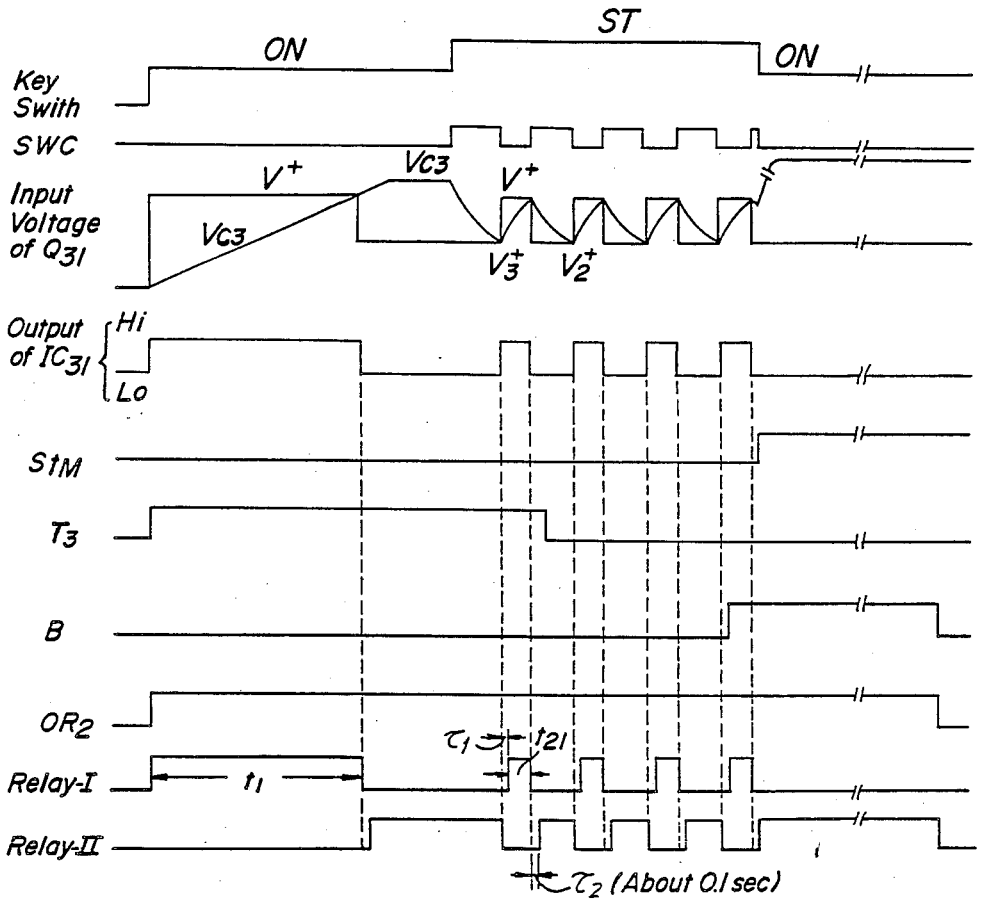
FIG. 6 is a time chart of the operation of the device of FIG. 5.

At the end of the time period $t_1$ starting from the turning of the key switch KS to the position ON, the output from the voltage comparator $IC_{31}$ is reduced to low Lo level, and the parallel-connection relay I is deenergized, as shown in FIG. 6. After a delay time $\tau_2$ of the delay timer $T_5$ from the deenergization of the parallel-connection relay I, the serial-connection relay II is energized on the conditions that the output from an OR circuit $OR_2$ is on Hi level, so as to keep the glow plugs P warm. When the output from the voltage comparator $IC_{31}$ is reduced to Lo, the output from the inverter $INV_{31}$ is turned to Hi level, and the collector of the transistor $Q_{32}$ of the memory circuit M is set Hi and kept at Hi.

When the key switch KS is turned to the start position ST under such conditions, a start signal ST is applied to a transistor $Q_{31}$, acting as a switching element, through a diode $D_{37}$ and a resistor $R_{314}$, so as to turn on the switch element transistor $Q_{31}$. Since the collector of the transistor $Q_{31}$ is connected to the capacitor $C_{31}$, the capacitor $C_{31}$ is discharged through a resistor $R_{322}$ and the transistor $Q_{31}$ on the conditions that the output from the inverter $INV_{31}$ is Hi while the start signal ST is present. The voltage at the plus (+) terminal of the voltage comparator $IC_{31}$ is now reduced to $V_2$+(FIG. 6) by the negative feedback resistor $R_{310}$.

When the voltage $V_{C3}$ of the capacitor $C_{31}$ is reduced to the level of $V_2$+, the output from the voltage comparator $IC_{31}$ is raised again to the high Hi level. Thus raised output voltage from the voltage comparactor $IC_{31}$ deenergizes the serial-connection relay II through the inverter $INV_1$, and after a time delay of $\tau_1$ of the delay time $T_4$ made of a monostable multivibrator or the like, the output from the $AND_1$ circuit is raised to Hi level so as to energize the parallel-connection relay I again. At this moment, the output from the inverter $INV_{31}$ is reduced to Lo, and the start signal ST, if exists, is absorbed by the diode $D_{38}$, so as to turn off the transistor $Q_{31}$ and to cease the discharge of the capacitor $C_{31}$. Under the conditions, the transistor $Q_{32}$ of the memory circuit M is turned off. Accordingly, the capacitor $C_{31}$ is charged through three circuits; namely from the terminal p1 of the glow plugs P through the voltage divider made of the resistors $R_{301}$ and $R_{302}$, from the same terminal p1 through another voltage divider made of resistors $R_{304}$ and $R_{305}$, and from the ON position of the key switch KS through the resistor $R_{306}$. The output from the voltage comparator $IC_{31}$ is kept at the high Hi level until the capacitor $C_{31}$ is charged to the voltage V+at the plus (+) terminal of the voltage comparator $IC_{31}$.

When the voltage $V_{C3}$ of the capacitor $C_{31}$ is raised to the above voltage V+, the output from the voltage comparator $IC_{31}$ is reduced to low Lo level, and the parallel-connection relay I is deenergized through the $AND_1$ circuit. After the delay time $\tau_2$ of the delay relay $T_5$ made of a monostable multivibrator or the like, the serial-connection relay II is energized. Thus, one cycle of the connection switching operation of the glow plugs P is completed. As long as the start signal ST is present, such oscillatory switching of the glow plug connection between parallel and serial takes place in the above-mentioned manner.

If the engine key switch KS is reversed from the start position ST to its ON position, the start memory circuit StM is actuated, so as to charge the capacitor $C_{31}$ instantly through a diode $D_{310}$. Thus, the output from the voltage comparator $IC_{31}$ is reduced to Lo level, and the parallel-connection relay I is deenergized and the glow plugs P are connected in a serial fashion for the after-glow operation, as shown in FIG. 8(*d*).

The reason for adding the voltage divider circuit of $R_{301}$ and $R_{302}$ to the charging circuit of the capacitor $C_{31}$ during the oscillating or chopping operation is as follows. Both the preheat time period $t_1$ during the pre-glow operation and the oscillatory heating time period $t_{21}$ during the oscillating or chopping operation depend on the voltage of the glow plugs P, so that, theoretically, the time periods $t_1$ and $t_{21}$ matching the characteristics of the glow plugs P can be produced without modifying the charging circuit of the capacitor $C_{31}$. However, in practice, the oscillatory heating time period $t_{21}$ during the chopping operation is very short as compared with the preheating time period $t_1$, for instance one-third to one sixth of $t_1$, and if the same charging circuit is used, the above mentioned low-level voltage $V_2$+at the plus (+) terminal of the voltage comparator $IC_{31}$ must be closer to the high-level voltage V+thereat as the oscillatory heating time period $t_{21}$ becomes smaller relative to the preheat time period $t_1$. To make the low-level voltage $V_2$+closer to the high-level voltage V+, the amount of the positive feedback must be reduced.

In the actual car, the voltage of the power source or car battery fluctuates widely during the engine cranking due to the loading of the starter motor. Besides, when the ambient temperature is low, the battery capacity is reduced and its output voltage becomes very low.

Even when a constant voltage circuit is provided in a voltage controller of the car, it is difficult to eliminate the adverse effect of the voltage fluctuation. To ensure proper operation of the above-mentioned voltage comparator circuit, a voltage hysteresis width (voltage difference between V+and $V_2$+after the positive feedback) of a certain magnitude is necessary. If the voltage hysteresis width is sufficiently large as compared with the magnitude of the voltage fluctuation in the constant voltage circuit, the risk of erroneous operation such as chattering can be eliminated.

Because of the above reason, to ensure satisfactory chopping by the voltage comparator $IC_{31}$ during the cranking, the difference between the high-level voltage V+and the low-level voltage $V_2$+at the plus (+) terminal of the voltage comparator $IC_{31}$ must be larger than a certain value. If the same charging circuit for the capacitor $C_{31}$ is used for both the preheating and the chopping, the ratio between the preheat $t_1$ and the ON time $t_{21}$ during the chopping is restricted by the above-mentioned voltage hysteresis width.

In order to provide a voltage hysteresis width larger than a certain value while matching the preheat time $t_1$ and the chopping ON time $t_{21}$ with the characteristics of the glow plugs P, it is preferable to provide different charging circuits for the capacitor $C_{31}$ so that the capacitor $C_{31}$ is charged rather slowly during the preheat time $t_1$ while it is charged rather quickly during the chopping ON time $t_{21}$. The memory circuit M of FIG. 5 is provided to facilitate the switching of the different charging circuits.

Thus, during the preheat timer $t_1$, the switching transistor $Q_{32}$ of the memory circuit M is made conductive so as to ground the charging circuit with the resistor $R_{301}$ and $R_{302}$ through the diode $D_{39}$, and the capacitor $C_{31}$ is charged through the voltage divider with the resistors $R_{304}$ and $R_{305}$ and through the other resistor $R_{306}$. On the other hand, during the chopping ON time $t_{21}$, the switching transistors $Q_{32}$ of the memory circuit M is turned off by using the Hi level output from the inverter $INV_{31}$ at the end of the preheat time $t_1$, and the charging circuit through the voltage divider with the resistors $R_{301}$ and $R_{302}$ is added to the charging circuits during the preheat time $t_1$, so that the capacitor $C_{31}$ is charged faster during such ON time than during the preheat time $t_1$.

In short, by switching the charging circuit of the capacitor $C_{31}$ in the above manner, the voltage hysteresis width is made larger than a certain value, and at the same time, the preheat time $t_1$ and the chopping ON time $t_{21}$ are matched with the characteristics of the glow plugs P.

Figure 7:
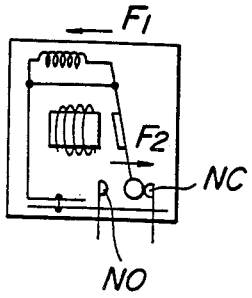
FIG. 7 is a schematic diagram of a mechanism for actuating the contact points of an electromagnetic relay; and Views (a) through (e) of FIG. 8 sequentially show the manner in which making and breaking of the relay contacts are effected during the switching of the glow plugs while avoiding the make and break under current-carrying conditions.
Figure 8A:
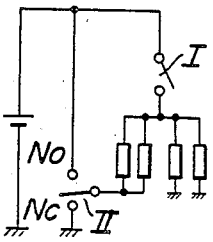
Figure 8B:
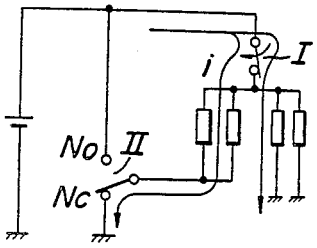
Figure 8C:
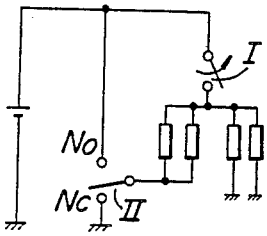
Figure 8D:
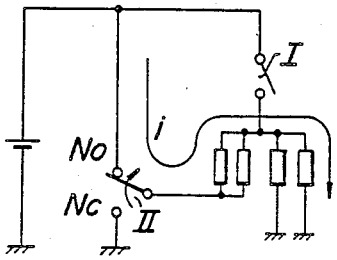
Figure 8E:
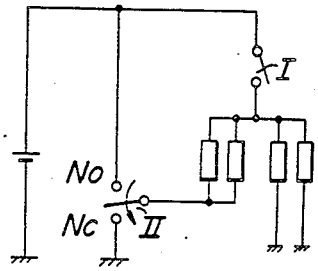

The protection of the relay contact points will be described now. FIG. 7 shows an embodiment of the transfer type relay which can be used as the serial-connection relay II. A moving contact point is urged against and kept in contact with a normally closed contact point NC by a force $F_2$, which is produced by amplifying a spring force $F_1$ by a lever means. On the other hand, the normally open contact point NO, which is used for serial connection of the glow plugs P in the embodiments of FIG. 1 and FIG. 5, is closed when the movable contact point is pulled by an electromagnet with a force stronger than the above-mentioned normally closing force $F_2$. Accordingly, when the normally open contact point NO is closed, the circuit is made without any bouncing of the contact points and without any damage to them.

However, when the normally closed contact point NC is closed, the movable contact point returns to its normal position only by the resilient force. Besides, the spring producing the above force $F_1$ assumes its shortest length when the movable contact point comes in contact with the normally closed contact point NC, so that the above closing force $F_2$ is minimized when the normally closed circuit point NC is closed, so that it is likely that the movable contact point comes into stable contact with the normally closed contact point NC only after bouncing several times. The closing pressure at the normally closed contact point NC is considerably smaller than that at the normally open contact point NO, so that the current making and breaking capability at the normally closed contact point NC is considerably lower than that at the normally open contact point NO.

One of the most frequent causes for the deterioration of relay contact points is the discharge at the time of making and breaking of the circuit at the contact point. Application of an electric current through a contact point under closed condition causes little damage to the contact point unless the current is excessively large. In a glow plug system including a transfer type relay, if current on-off operation is avoided at the normally closed contact point of such relay, the durability of the relay can be considerably improved and the system can be made highly practicable.

The following method may be used to avoid the current on-off operation at the normally closed contact point.

(i) During pre-glow period

The normally closed contact point NC of the serial-connection relay II is kept under closed condition when the engine key switch KS is at its OFF position. When the engine key switch KS is turned to its ON position, the current is applied at the normally open contact of the parallel-connection relay I. After the preheat time $t_1$, the parallel-connection relay I is deenergized, and the normally closed contact point NC of the serial-connection relay II is kept free from any current for the time $\tau_2$ (e.g., about 0.1 second) by the delay timer $T_5$ made of a monostable multivibrator or the like, and then the circuit of the serial-connection relay II is completed for the keep-warm operation.

(ii) During the cranking operation

When the chopping for the parallel-serial switching is effected by the start signal ST, after the serial-connection relay II is deenergized, the normally closed contact point NC is kept as fully closed without any current for $\tau_1$ (e.g., about 0.16 second) by the delay timer $T_4$, and then the current is applied at the normally open contact point of the parallel-connection relay I for the keep-warm operation. After the ON time $t_{21}$, the parallel-connection relay I is de-energized and the current is completely interrupted for $\tau_2$ by the delay timer $T_5$, and then the current is applied through the normally open contact point of the serial-connection relay II. Thus, all the current making and breaking is effected through the normally open contact point.

(iii) During the after-glow operation

If the parallel-connection relay I is on, the current is completely interrupted for $\tau_2$, and then the current is applied through the normally open contact of the serial-connection relay II. If the serial-connection relay II is on, the current through the serial circuit is maintained. Thereby, the after-glow operation is effected.

For switching the current from the parallel-connection relay I to the serial-connection relay II and vice versa, the making of the circuit at the relays I and II is delayed as shown in FIG. 8(*a*) through FIG. 8(*e*), so that the current making and breaking at the normally closed contact point NC of the serial-connection relay II is purposefully avoided.

As described in detail in the foregoing, a method and a device for applying currents to glow plugs according to the invention eliminate the use of the conventional current-limiting resistors, so that the waste of power in such current-limiting resistors is avoided. The invention is featured in that the heating of the glow plugs is effected in three stages; namely, the preheating period for quickly raising the temperature of the glow plugs, the cranking period for driving the engine starter motor, and the after-glow period. Whereby, power consumption in the glow plugs is controlled in an optimal manner. The required preheating of the glow plugs and the subsequent keeping of the temperature of the thus preheated glow plugs can be carried out in an accurate manner without causing any extra burden to the power source or car battery, whereby the starting and warming up characteristics of engines are improved. Especially, the parallel-serial switching of the glow plug connection is effected when the engine starter motor is driven, while minimizing the possible unpleasant flicker in the car lighting system during such switching.

Although the invention has been described with a certain degree of particularity, it is understood that the present disclosure has been made only by way of example and that numerous changes in details of construction and the combination and arrangement of parts may be resorted to without departing from the scope of the invention as hereinafter claimed.

What is claimed is:

1. A method for applying electric currents to glow plugs for cylinders of an engine, comprising steps of electrically connecting a plurality of glow plugs through a switch means in such a manner that the glow plugs can be selectively connected in parallel to each other, connected in serial to each other, applying electric currents to the parallel-connected glow plugs through said switch means for preheating the glow plugs before cranking of the engine, applying electric currents to the glow plugs while intermittently switching connection thereof from parallel to serial and vice versa with intervening predetermined time intervals in which no current is applied to the glow plugs between each switching from parallel to serial and vice versa during the cranking of the engine, and applying electric currents to the serial-connected glow plugs after the engine is started by the cranking.

2. A mwethod for applying electric currents to glow plugs for cylinders of an engine as set forth in claim 1, wherein duration of at least one of said parallel-connection and said serial-connection of the glow plugs during said intermittent switching is adjusted depending on voltage applied to said glow plugs.

3. A method for applying electric currents to glow plugs for cylinders of an engine as set forth in claim 1, wherein a delay time is provided after each of said intermittent switching of the glow plugs from parallel to serial and vice versa during the cranking of the engine.

4. A device for applying electric currents to glow plugs of engine cylinders, comprising an engine key switch having an ON position for making a circuit connected to a power source and an ST position for cranking the engine;

a first switch means adapted to connect the glow plugs in parallel to each other and to couple the parallel-connected glow plugs to the power source;

a second switch means adapted to connect the glow plugs in a serial manner and to couple the serial-connected glow plugs to the power source;

a selective means operatively connected to both said first and second switch means and adapted to sequentially actuate only one of said first switch means and said second switch means at a time dependent upon at least one control signal with predetermined intervening time intervals between each actuation;

a preheat timer connected to said ON position of the engine key switch and adapted to produce a high-level signal for a certain preheat time after the engine key switch is turned to the ON position;

an oscillator circuit connected at least to said ST position of the engine key switch and adapted to intermittently produce high-level signals when the engine key switch is at the ST position; and an OR circuit having inputs thereof connected to both said preheat timer and said oscillator circuit and the output of said OR circuit coupled to said selective means and carrying said at least one control signal wherein said first switch means is actuated through said selective means.

5. A device for applying electric currents to glow plugs of engine cylinders as set forth in claim 4, wherein said oscillator has a voltage comparator having a first input terminal coupled to said ON position of the engine key switch and a second input terminal coupled to a capacitor, said voltage comparator being adapted to produce a high-level output signal when voltage at said first input terminal is higher than voltage at said second input terminal, a charging circuit adapted to be triggered by a signal from said ST position so as to couple voltage of the glow plug to the capacitor, and a discharge circuit adapted to be triggered by an inverse of low-level output from the voltage comparator under the presence of the signal from the ST position so as to discharge the capacitor.

6. A device for applying electric currents to glow plugs of engine cylinders as set forth in claim 4, wherein said oscillator has a voltage comparator having a first input terminal coupled to said ON position of the engine key switch and a second input terminal coupled to a capacitor, said voltage comparator being adapted to produce a high-level output signal when voltage at said first input terminal is higher than voltage at said second input terminal, a charging circuit adapted to be triggered by a signal from said ST position so as to couple voltage of the glow plug to the capacitor, a discharge circuit adapted to be triggered by an inverse of low-level output from the voltage comparator under the presence of the signal from the ST position so as to discharge the capacitor, and another charging circuit adapted to be triggered by an inverse of a signal triggering said discharge circuit so as to couple voltage of serial-conncected glow plugs to the capacitor through a diode.

7. A device for applying electric currents to glow plugs of engine cylinders, comprising an engine key switch having an ON position for making a circuit connected to a power source and an ST position for cranking the engine;

a first switch means adapted to connect the glow plugs in parallel to each other and to couple the parallel-connected glow plugs to the power source;

a second switch means adapted to connect the glow plugs in a serial manner and to couple the serial-connected glow plugs to the power source;

a preheat timer connected to both said ON position and said ST position of the engine key switch and including a voltage comparator having a first input terminal coupled to said ON position of the engine key switch and a second input terminal coupled to a capacitor, said voltage comparator being adapted to produce a high-level output signal when voltage at said first input terminal is higher than voltage at said second input terminal;

a charging circuit adapted to be triggered by signal from said ST position so as to couple voltage of said glow plug to the capacitor through a voltage divider;

a discharge circuit adapted to be triggered by an inverse signal of low-level output from the voltage comparator under the presence of the signal from the ST position so as to discharge the capacitor; and a selective means connected to said preheat timer and adapted to sequentially actuate only one of said first and second switch means at a time with predetermined intervening time intervals between each actuation while actuating only said first switch means when the high-level output signal is received from said preheat timer.

8. A device for applying electric currents to glow plugs of engine cylinders as set forth in claim 7, wherein said charging circuit being adapted to apply voltage of said glow plugs to said capacitor through a first voltage divider.

9. A device for applying electric currents to glow plugs of engine cylinders as set forth in claim 7, wherein said device further comprising another charging circuit adapted to be triggered by said inverse signal triggering said discharge circuit so as to couple voltage of the glow plugs to the capacitor through another voltage divider.

10. A device for applying electric currents to glow plugs of engine cylinders as set forth in claim 7, wherein said another charging circuit is adapted to couple voltage of the serial-connected glow plugs to the capacitor through said other voltage divider.

* * * * *